United States Patent [19]

Gagne

[11] Patent Number: 4,837,986

[45] Date of Patent: Jun. 13, 1989

[54] AUTOMATIC SKYLIGHT ACTUATOR

[76] Inventor: Serge G. Gagne, 15 Westfield St., Manchester, Conn. 06040

[21] Appl. No.: 180,565

[22] Filed: May 24, 1988

[51] Int. Cl.[4] ..... E04H 9/00

[52] U.S. Cl. ..... 52/1; 52/200; 52/72; 126/418; 126/419

[58] Field of Search ..... 52/1, 71, 72, 200; 49/64, 86; 126/418, 419

[56] References Cited

U.S. PATENT DOCUMENTS

| | | | |
|---|---|---|---|
| 3,577,691 | 5/1971 | Kallin | 52/72 |
| 4,010,577 | 3/1977 | Stalter | 52/1 |
| 4,079,555 | 3/1978 | Barnes | 52/1 X |
| 4,365,615 | 12/1982 | Melvin | 126/419 |
| 4,477,145 | 10/1984 | Mori | 126/439 X |
| 4,505,069 | 3/1985 | Freeman | 52/200 X |
| 4,616,451 | 10/1986 | Glick | 52/72 X |
| 4,671,023 | 6/1987 | Gigli | 52/1 |

*Primary Examiner*—David A. Scherbel

*Assistant Examiner*—Creighton Smith

*Attorney, Agent, or Firm*—H. Jay Spiegel & Associates

[57] ABSTRACT

The present invention relates to an automatic skylight actuator designed to be incorporated into a skylight of the type which may be actuated to open and closed positions through the use of an electrical actuator such as a rotary motor. The inventive actuator includes two sensors, one for sensing rain outside the building where the skylight is installed and the other for measuring the room temperature within the room in the building having the skylight therein. When the temperature sensor senses that the temperature within the room is above a predetermined level the actuator is operative to cause the skylight to be opened, whereas when the room temperature drops below a perdetermined level, the skylight is closed. When the rain gauge senses that it is raining outside, the actuator is triggered to cause the skylight to be closed. Whenever the rain gauge senses the existence of rain, acutation by temperature sensing is disabled.

6 Claims, 1 Drawing Sheet

FIG. 1
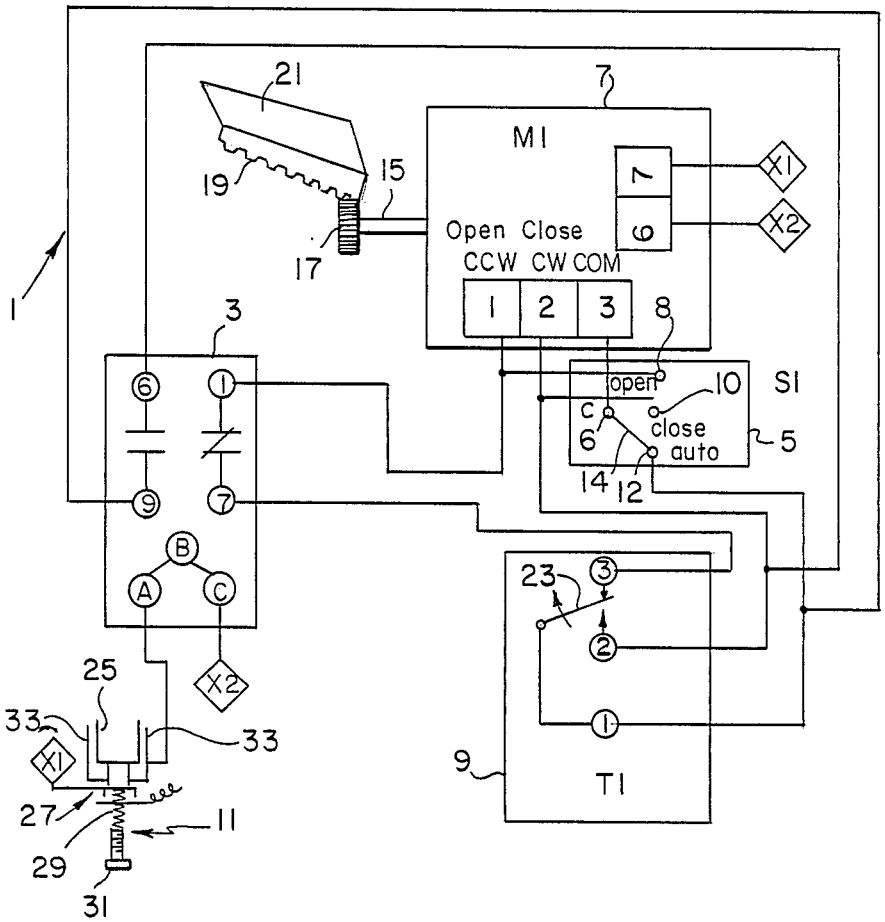
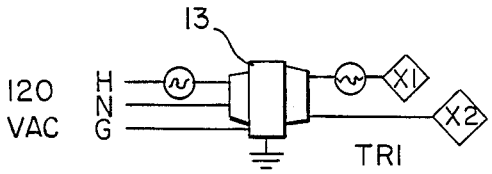
FIG. 2

AUTOMATIC SKYLIGHT ACTUATOR

BACKGROUND OF THE INVENTION

The present invention relates to an improved automatic skylight actuator. In the prior art, skylights are well known and U.S. Pat. No. 1,239,421 to Metzger, U.S. Pat. No. 3,577,691 to Persson, et al. and U.S. Pat. No. 4,616,451 to Glick each teach the concept of a skylight which may be opened. Each of these patents teaches a skylight which may be opened through a remote actuation.

Furthermore, U.S. Pat. No. 4,671,023 to Gigli teaches the concept of a covering device including a plurality of louvers which may be pivoted due to the weight of accumulated rain therein. This is different from the teachings of the present invention wherein an electrical skylight actuator is activated responsive to the sensing of rain in a rain gauge.

SUMMARY OF THE INVENTION

The present invention overcomes the deficiencies found in the prior art as set forth hereinabove and provides a new and improved automatic skylight actuator which is easy to install and effective in its operation. The present invention includes the following interrelated aspects and features.

(a) In a first aspect, the present invention may be incorporated in any electrical skylight actuator. Such actuators may take on several forms depending upon the particular structure of the associated skylight. The most common types of movable skylights operate either through a sliding movement or a pivoting movement. In either case, the rotary motion of a motor shaft is translated into movement of the skylight through suitable gearing. In the case of a sliding skylight, the most common means of actuation comprises a rack and pinion type actuator. In the case of a pivoting skylight, the most common type of actuator comprises a reduction gear connected to a pivoting arm slidably mounted on the skylight structure to allow pivoting of the arm to pivot the skylight to open and closed positions.

(b) The inventive actuator includes a plurality of modes of operation. Firstly, the invention includes a three-position switch including one position wherein automatic operation takes place, a second position wherein the motor is manually actuated to cause the skylight to close and a third position wherein the motor is actuated to cause the skylight to open.

(c) In the automatic position of the switch, where no rain is present outside the building wherein the skylight is installed, a thermostat may be set within the room where the skylight is located so that when the temperature within the room rises above a predetermined level, the skylight may open to cause the room to cool and whereby when the room temperature reduces below a predetermined level, the skylight is automatically closed.

(d) If the skylight is open and the rain gauge detects that it is raining, the electrical motor will automatically be activated to cause the skylight to close. When the skylight is already closed and the rain gauge detects rain, such detection will prevent temperature sensing from being operative to activate the skylight to an open position.

Accordingly, it is a first object of the present invention to provide and improved automatic skylight actuator.

It is a further object of the present invention to provide such an improved automatic skylight actuator which allows activation of a skylight either manually or automatically.

It is a further object of the present invention to provide such an automatic skylight actuator which allows the skylight to be closed whenever it is raining outside the building wherein the skylight is located.

It is a still further object of the present invention to provide such an actuator which may control the operation of the skylight responsive to sensing of temperature in the room where the skylight is located.

These and other objects aspects and features of the present invention will be better understood from the following detailed description of the preferred embodiments when read in conjunction with the appended drawing figures.

BRIEF DESCRIPTION OF THE DRAWINGS

FIG. 1 shows a schematic view of a portion of the electrical circuitry of the present invention.

FIG. 2 shows a schematic view of the remainder of the electrical circuitry including the power source therefor.

SPECIFIC DESCRIPTION OF THE PREFERRED EMBODIMENT

With reference to FIG. 1, it is seen that the inventive circuit 1 includes a relay 3, a switch 5, a motor 7, a thermostat 9 and a rain gauge 11. With reference to FIG. 2, a transformer 13 is provided to step down 120 volts AC to 24 volts AC. As should be understood by comparison of FIGS. 1 and 2, the stepped down output terminals X1 and X2 of the transformer 13 are connected into the circuit 1 shown in FIG. 1 through respective connection to the terminals X1 and X2 shown therein. As seen in FIG. 1, there are two X1 terminals, one adjacent the rain gauge 11 and the other connected to the motor 7. There are also two X2 terminals, one connected to the relay 3 and the other connected to the motor 7.

As seen in FIG. 1, the motor 7 has an output shaft 15 shown to have a pinion gear 17 attached thereto and constrained to move therewith, which pinion gear 17 is designed to interengage with a rack 19 so that rotation of the pinion gear 17 by the shaft 15 will cause reciprocation of the rack 19, and thereby the skylight 21 attached thereto. As stated above, the particular mode of actuation of the skylight does not form a part of the present invention and such mode of actuation may include reciprocation, pivoting or other mode of actuation.

In the preferred embodiment of the present invention, the relay 3 consists of a 24 volt AC coil and two form C contacts. When power is applied to the coil, the contacts designated 6 and 9 will close and the contacts designated 1 and 7 will open. When power is removed from the coil terminals, the contacts designated 1 and 7 will close and the contacts designated 6 and 9 will open.

The switch 5 consists of a three-position toggle switch known as a three-pole, single-throw switch. As seen in FIG. 1, the switch 5 includes a common contact 6, and three other contacts 8, 10 and 12. A contact blade 14 is provided which is always connected to the common contact 6 at one end thereof and at the other end may selectively be placed into contact with one of the three terminals 8, 10 or 12.

As should be understood from FIG. 1, when the contacts 6 and 8 are interconnected by the blade 14, the motor 7 is actuated in a direction of rotation designed to cause the skylight 21 to be opened. When the contacts 6 and 10 are interconnected by the blade 14, the motor 7 is rotated in the opposite direction so that the skylight 21 is closed. When the contacts 6 and 12 are interconnected by the blade 14, automatic operation takes place as will be described in greater detail hereinafter.

The thermostat 9 comprises an electric thermostat with an adjustable set point designed to provide a form C contact responsive to a rise in temperature above a predetermined amount and a drop in temperature below a predetermined amount. The thermostat 9 has a bimetallic strip 23 which upon a rise in temperature above the predetermined level will short the common terminal 1 thereof with the terminal 3 thereof and will thereby open connection between the terminals 1 and 2. As the inventive circuit 1 is designed, such connection will cause the motor 7 to be actuated in a direction opening the skylight 21.

Conversely, when the temperature drops below a predetermined level sufficient to cause the bimetallic strip 23 to engage the contact 2 to thereby close a circuit between the contacts 1 and 2 of the thermostat 9, the motor 7 will be actuated in a direction to close the skylight 21.

The rain gauge 11 may be of any type including the type which senses the presence of rain by the weight of water in a cup or the type wherein the presence of rain causes two spaced plates to be connected through a water path. In the preferred embodiment of the present invention, the rain gauge consists of a cup 25 sitting on top of a microswitch 27 which has a form C contact. Springs 29 are attached to a cup holder 33 thereof and a screw 31 may be utilized to adjust tension on the assembly. Such adjustment allows for different amounts of rain to trigger the mechanism.

The electric motor 7 is designed to operate on 24 volts AC and includes three terminals numbered 1, 2 and 3 in the figure with 3 being the common terminal, 2 corresponding to clockwise rotation of the motor and 1 representing counterclockwise rotation of the motor. As should be understood, when the terminals 2 and 3 are interconnected by the switch 5 or through automatic actuation, the motor will rotate in a clockwise direction. Conversely, when the terminals 1 and 3 are interconnected, the motor will rotate counterclockwise.

Having explained the circuitry of the present invention, the operation of the present invention will now be described.

With reference to the switch 5, when the switch 5 is in the position wherein the contacts 6 and 8 are interconnected, the motor 7 will be rotated in a direction causing the skylight 21 to be opened. Conversely, when the contacts 6 and 10 are interconnected, the motor 7 will be rotated in the opposite direction to cause the skylight 21 to be closed.

In the position of the switch 5 wherein the contacts 6 and 12 are interconnected, automatic operation of the inventive circuit 1 will take place. Firstly, it is assumed that the thermostat 9 is located within a room in a building which has the skylight 21 therein. Furthermore, it is assumed that the rain gauge 11 is located outside the building in an area adjacent the opening which is controlled by the skylight 21.

In a situation wherein the rain gauge 11 is empty, on rise in temperature in the above described room above a predetermined set amount, the terminals 1 and 3 of the thermostat 9 will be interconnected to cause current to flow from the common terminal 3 of the motor 7 through the terminals 6 and 14 of the switch 5 through the terminals 1 and 3 of the thermostat 9, through the terminals 7 and 1 of the relay 3 to the terminal 1 in the motor 7. Such flow of current will cause the motor 7 to rotate counterclockwise to move the skylight 21 to the open position.

When the temperature in the room drops sufficiently to cause the bimetallic element 23 of the thermostat 9 to drop into engagement with the terminal 2 of the thermostat 9, this will cause current to flow from the common terminal 3 of the motor 7 through the common terminal 6 and the auto terminal 14 of the switch 5, through the common terminal 1 of the thermostat 9 through the terminal 2 of the thermostat 9 to the terminal 2 of the motor 7 to thereby cause the motor 7 to rotate clockwise to thereby close the skylight 21.

Under circumstances wherein the rain gauge 11 is sufficiently wet enough to cause the switch 27 thereof to be closed, this will cause the contacts 6 and 9 of the relay 3 to be closed and the contacts 1 and 7 of the relay 3 to be opened. Under such circumstances, current flow from the terminal 3 of the motor 7 to the terminal 1 of the motor 7 will be broken to prevent the skylight 21 from being opened. When the contacts 6 and 9 on the relay 3 are closed, current will be caused to flow between the terminals 3 and 2 of the motor 7 to thereby close the skylight if it is in fact open. Thus, under such circumstances, the skylight will remain closed until water in the cup 25 of the rain gauge 11 is poured out or evaporated or, alternatively, the switch 5 is moved to interconnect contacts 6 and 8 for manual actuation.

Accordingly, the present invention has been described in terms of a preferred embodiment thereof which fulfills each and every one of the objects of the invention as set forth hereinabove and provides a new and improved actuator device for a skylight which may be used to advantageous effect. Of course, various changes, modifications and alterations in the teachings of the present invention may be contemplated without departing from the intended spirit and scope thereof. As such, it is intended that the present invention only be limited by the terms of the appended claims.

I claim:

1. In a skylight including a frame mounted about an opening in a room in a building, and a closure actuable between open and closed positions with respect to said frame, an actuator for said skylight comprising:

(a) an electric motor having a rotary output shaft operatively connected to said closure whereby rotation of said shaft in a first direction opens said closure and rotation of said shaft in a second opposite direction closes said closure;

(b) an actuation circuit connected to said motor and comprising:

(i) temperature sensing means in said room for sensing the temperature in said room and causing said motor to open said closure when the temperature in said room exceeds a first predetermined level and causing said motor to close said closure when the temperature in said room drops below a second predetermined level;

(ii) rain gauge means mounted on said building adjacent said opening for sensing rain and responsive thereto causing said motor to close said closure; and (iii) disabling sub-circuit means interconnected between said rain gauge means and said motor for disabling said motor from operation when said closure is closed and rain is sensed.

2. The invention of claim 1, wherein said circuit includes a transformer having outpost terminals providing 24 volts AC.

3. The invention of claim 1, wherein said circuit includes a relay having a coil and two pairs of contacts, whereby when said coil is energized a first pair of said contacts is closed and a second pair of said contacts is opened, and whereby when said coil is de-energized, said first pair of contacts is opened and said second pair of contacts is closed.

4. The invention of claim 1, wherein said rain gauge includes a cup mounted over a microswitch having an adjustable spring enabling adjustment of the amount of rain in said cup required to close the microswitch.

5. The invention of claim 1, wherein said temperature sensing means includes a bimetallic sensing element.

6. The invention of claim 1, wherein said circuit includes a switch with three positions, a first position causing operation of said motor to open said closure, a second position causing closing of said closure by said motor and a third position causing operation of said closure responsive to operation of said temperature sensing means, rain gauge means and disabling sub-circuit means.

* * * * *